US005682626A

United States Patent [19]

Banks, Jr. et al.

[11] Patent Number: 5,682,626

[45] **Date of Patent: *Nov. 4, 1997**

[54] INVALID BATH CHAIR WITH THERAPEUTIC WHIRLPOOL

[76] Inventors: David S. Banks, Jr.; Catherine B. Banks, both of 3411 Oakcrest Dr., Shelby, N.C. 28150

[ * ] Notice: The terminal 24 months of this patent has been disclaimed.

[21] Appl. No.: 216,849

[22] Filed: Mar. 24, 1994

[51] Int. Cl.[6] ..... A47K 3/12; A61H 33/06

[52] U.S. Cl. ..... 4/541.5; 4/579

[58] Field of Search ..... 4/496, 541.3, 541.4, 4/541.5, 559, 568, 569, 571.1, 573.1, 578.1, 579, 604, 611

[56] References Cited

U.S. PATENT DOCUMENTS

| | | | |
|---|---|---|---|
| 2,174,445 | 9/1939 | Oliver | 4/541.5 X |
| 2,921,579 | 1/1960 | Munroe | 4/541.5 |
| 3,040,335 | 6/1962 | Gellmann | 4/579 X |
| 3,111,686 | 11/1963 | Sierant | 4/541.5 |
| 3,138,153 | 6/1964 | Osborn et al. | 4/559 X |
| 4,034,425 | 7/1977 | Van Riemsdyek | 4/579 |
| 4,166,297 | 9/1979 | Saleeby | 4/578.1 |
| 4,340,981 | 7/1982 | Vanags | 4/536 |
| 4,417,568 | 11/1983 | Nozawa et al. | 4/541.5 |
| 4,656,678 | 4/1987 | Lipski | 4/578.1 |
| 4,780,916 | 11/1988 | Sutton | 4/541.5 |
| 4,986,781 | 1/1991 | Smith | 4/541.3 X |
| 5,103,509 | 4/1992 | Richards | 4/564.1 |

FOREIGN PATENT DOCUMENTS

| | | | |
|---|---|---|---|
| 0980122 | 1/1965 | United Kingdom | 4/568 |

OTHER PUBLICATIONS

"Activeaid", Tub/Commode Chair, Model 277, 1989, 2 pgs.

*Primary Examiner*—Robert M. Fetsuga
*Attorney, Agent, or Firm*—Clifton Ted Hunt

[57] ABSTRACT

A chair having an open seat includes a hydro pad supported thereunder for creating a therapeutic whirlpool effect. The chair is utilized in a bath for treatment of perineal and perianal illnesses. The hydro pad comprises a shallow, substantially rectangular plenum with a plurality of air injection ports through the upper surface. By an electric motor air is forced through the plenum for creation of the whirlpool effect in the water beneath the chair seat.

6 Claims, 2 Drawing Sheets

INVALID BATH CHAIR WITH THERAPEUTIC WHIRLPOOL

BACKGROUND AND SUMMARY

The current invention relates to the amelioration of injury and pathogenic conditions through the use of home or satellite whirlpool therapy away from a typical hospital setting. Specifically this novel bath seat with whirlpool apparatus facilitates health, hygiene, and rehabilitation of the peritoneal, perinanal, and female vaginal areas of the body.

According to the present invention, a patient with a peritoneal, perianal, or vaginal condition is placed in a home bathtub, seated on the chair which has a seat that is open toward the rear. A novel "Hydro Pad" depends below the chair seat, creating a churning whirlpool effect in a partially filled tub; thus bathing the perineal and aforementioned body cavities with a whirlpool action via the open seat.

Whirlpool treatments are of significant medicinal value when treating surgical and pathogenic conditions including but not limited to; hemorrhoids or hemorrhoid surgery, appendectical or groin surgeries, vaginal surgeries or episiotomies, pathogen therapy, peritoneal wounds, decubitus ulcers, postpartum complications or other rectal surgeries and conditions.

It is important that whirlpool therapy not be regarded as simply palliative or as even an extraneous procedure in the aftermath of surgery or during the course of disease. It has been shown that regular home whirlpool treatments with a prototype of the current invention shortened average healing time by more than fifty percent for a senior-adult female patient in the aftermath of significant rectal surgery with complications.

The specific medicinal benefits that induce physicians to frequently prescribe heretofore expensive and equipment intensive whirlpool therapy in a hospital setting include the following: sedative action by relieving pain and relaxing spasm; produces vasodilation and improves local arterial and lymphatic circulation; softens scar tissue and breaks down old adhesions; cleanses, debreds and stimulates wounds; mechanically removes dirt, necrotic tissue and pus; causes a regression of inflammatory process and diminution of edema and effusion.

The very competent whirlpool or "massage de'bridement" brought about by the current invention includes water temperature and agitation controls heretofore associated with large and expensive "Hubbard tanks" or invalid sitz baths typically found in hospitals or large clinic settings. The current invention also accommodates the use of water additive medicinals that includes but is not limited to: minerals, sulfurs, and mild antiseptics.

A concomitant to the whirlpool process of the current invention is a "jet douche" accomplished by using a standard bath hose attached to the tub-faucet so that irrigation cleansing and massage of body cavities, wounds, and surface skin can be accomplished.

The novelty of the current invention is illustrated by related prior art that fails in every means to combine invalid tub seating with a whirlpool therapeutic effect. U.S. Pat. No. 4,166,297 is a bath safety chair but with one pair of side legs depending on the outside of a hollow tunnel that fits over the tub ledge wall. U.S. Pat. No. 4,656,678 is a backless invalid stool for a bathtub, foldable, with anti skid strips. U.S. Pat. No. 5,103,509 teaches a motorized lift-chair for tub access and egress. U.S. Pat. No. 4,340,981 is a self contained cabinet bathing apparatus that recycles waters and steam but cannot provide a whirlpool effect. There is no known prior art that provides a whirlpool means, with portable seating, for use in individual circumstances.

The current invention is comprised of a bathtub chair with gripping suction feet attenuating to four chair legs and having a seat bottom which is open in the middle, describing a thick, rearwardly facing C-shape. The seat provides both adequate support for the buttocks and an open core for whirlpool bathing of the anal, groin, and vaginal areas. A novel "hydro pad" apparatus, depending on the chair legs below the seat, provides the whirlpool-like water agitation via upfacing air injectors made into the top surface of the hydro pad. The invalid's perinea, located at and below the water line, is thoroughly bathed in a whirlpool action.

The air driven hydro pad is powered by a conventionally configured compressor motor. The compressor is connected to the hydro pad via a flexible air hose with motor controls allowing intensity adjustment for whirlpool agitation. Compressed air temperature is variably controlled by a thermostatic device operatively connected with the motor and thus the water heat is regulated indirectly by the temperature of the air agitating the tub water thereby.

Air compressors with heat coils are, by themselves, not novel. All components of aforementioned current invention are movable and to a great degree portable.

In due consideration of the novel and useful features of the "Invalid Bath Chair With Attached Therapeutic Whirlpool" the following objectives for the current invention are derived as they relate to the therapeutic treatment of the perianal, peritoneal, and vaginal areas of the body:

It is an objective of the current invention to provide in-home, medicinal whirlpool facilities for an invalid.

It is yet another objective of the current invention to facilitate a satellite, home care, or clinical, whirlpool as an alternative to equipment intensive "Hubbard Tanks" or Sitz baths commonly found only in hospitals or large clinics. The said invention accomplishes this in a movable and portable configuration.

It is another objective of this invention to make a medically salutary whirlpool available at frequent intervals for the home-bound invalid without the associated dangers and discomforts of vehicular transport to and from the hospital.

It is yet another objective of the current invention to minimize heretofore requisite and costly physician referral, expensive hospital whirlpool prescriptions.

It is another objective of the current invention to allow invalid showering or tub soaking with or without the whirlpool effect brought about by the Hydro Pad and compressor combination.

DETAILED DESCRIPTION OF PREFERRED EMBODIMENT

Figure 1:
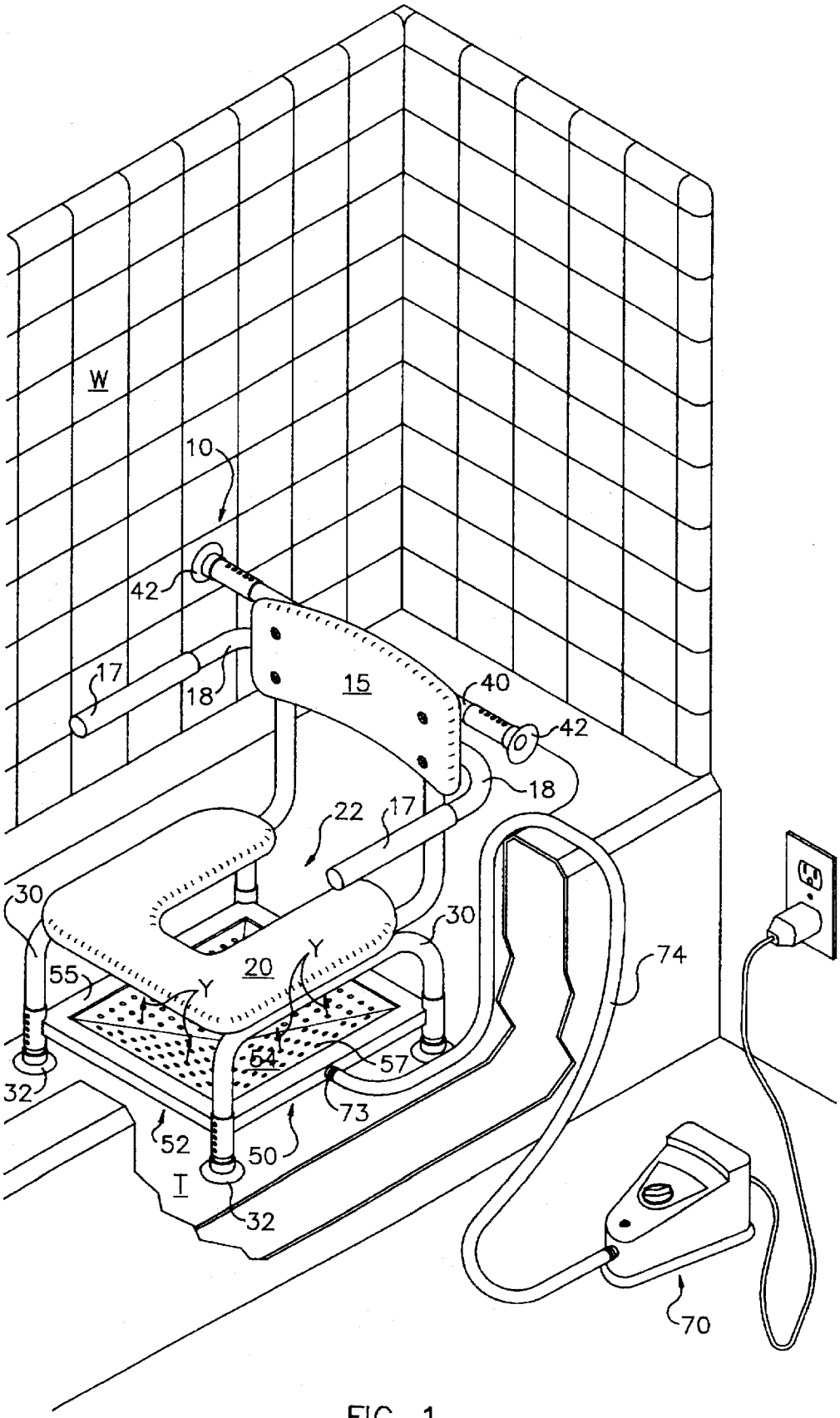
FIG. 1 is a perspective view, with parts broken away, illustrating a bathtub and an operable installation of the invention.
Figure 2:
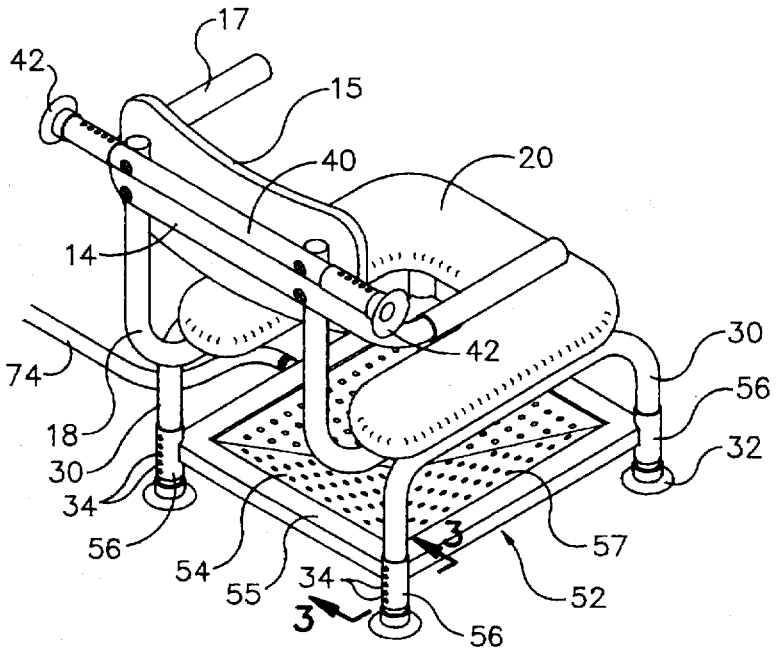
FIG. 2 is a perspective view of the chair removed from the bathtub, and looking at the side not shown in FIG. 1.

FIG. 1 overall shows an apparatus broadly resembling a chair of tubular construction but with important functional distinguishments henceforth described. The chair 10 comprises a tubular construction including support 14 for a back 15, four legs 30 and stabilizers 40. A seat 20 is supported on the four legs 30. The seat 20 has an opening 22 in its medial portion and a whirlpool apparatus 50 is mounted underneath the open seat, and is operatively connected to a motor 70. The chair 10 is designed for use in a home bathtub or other water bath and to grip a supporting surface T via a plurality of suction cups 32 functioning as the feet of each of four legs 30. In addition bilateral suction cups 42 are mounted on stabilizers 40 which telescopically extend to one selected side and affix to the tile or other wall W of the tub enclosure. The stabilizers 40 depend from the upper rear surface of a bracket back-rest support 15.

Parallel arm rests 17 depend from an L-shaped bracket mount 18 mounted to the seat back 15, below stabilizer 40. The arm rests provide support and comfort during entry to and egress from said chair apparatus. Padded arm supports may be added if desired.

Figure 4:
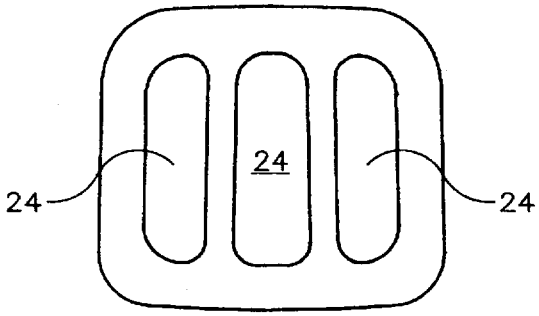
FIG. 4 is a plan view of an alternate embodiment of the seat for the chair.

Proper irrigation of affected body areas mandates a special openly configured seat 20 that provides peripheral support for the legs and buttocks while allowing maximum whirlpool bathing effects to occur. The seat 20 takes on a crescent or elongated half-doughnut configuration, also describing a rearwardly facing C-shape, similar to, and sometimes interchangeable with, a conventional commode seat. The intermediate open area 22 preferably faces the rear of the chair, for less interference with proper application of water to the patient's body. The seat 20 is removable and replaceable for cleaning or size substitutions. Preferably the seat 20 is formed of soft, flexible urethane for comfort. It is secured to the chair by means of screws or other conventional fasteners (not shown). An alternate seat is shown in FIG. 4, wherein there are two or three slot-type openings 24 for application of water therapy to other areas such as the buttocks.

Figure 3:
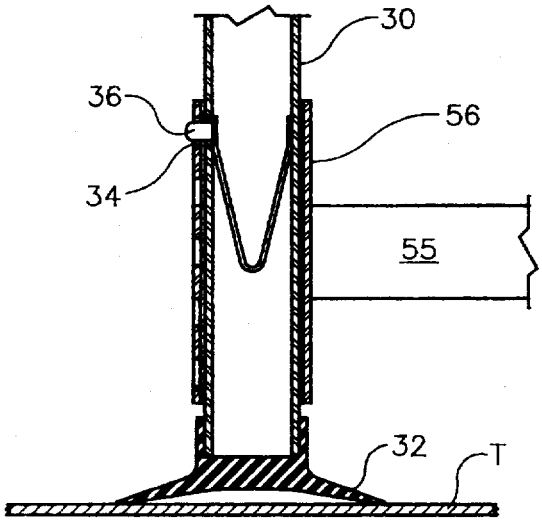
FIG. 3 is a sectional view, taken substantially along the line 3—3 in FIG. 2.

The whirlpool effect takes place in an area between the seat 20 and the top of facing surface of a hydro pad 52. The upper surface 54 of the hydro pad 52 function as the emanation point of air-induced, moiling or churning water. The hydro pad is height adjustable if desired, for altering the force of the whirlpool effect on the area being treated. FIG. 3 details the adjustability of the hydro pad 52 via the telescoping movement of tubular brackets 56 relative to the legs 30. The hydro pad 52 is held in an adjusted position by pins 36 that extend through apertures 34 in the tubular brackets 56 that register with a corresponding aperture, not shown, in the legs 30.

The hydro pad 52 is a substantially rectangular plenum device attached via a frame 55 and brackets 56 to the inside of each of the chair legs 30. The plenum is defined at the outer perimeter by elongated rectangular air channels that form the frame 55, and the aperture upper plate 54. An underplate (not shown) is air and water impervious and forms the bottom of pad 52. This forces the air to more upward through the apertures in plate 54 in the direction of arrows "Y".

Most of the upper surface area of the hydro pad plenum is a recessed planar surface plate 54 with a plurality of air injector apertures 57 stamped there through. The back or bottom facing surface of the hydro pad is solid, thus defining the hydro pad as a closed cavity with the air injector perforations 57 as the only points of air emanation to the water.

The source of air pressure energizing the hydro pad is a motor 70 of standard configuration with variable output levels to adjust the force of the whirlpool. The motor further includes heating coils which are thermostatically adjustable to affect heated-air induced water temperature. This is a conventional configuration known in other types of portable spas.

A tubular nozzle (not shown) is mounted on a receptor boss 73 depending from the outfacing surface side of frame 55. A flexible hose 74 conveys compressed air from the room into the plenum, pressurizing the hydro pad and forcing air through the plurality of air injector apertures 57.

Materials for the components of the current invention include tubular anodized aluminum stainless steel, or plastics such as rigid tubular PVC construction for the chair frame. Polyethylene, urethane, or other soft material is desirable for the back rest and commode type seat. However, other types and forms of materials may be used as desired. While a preferred embodiment has been shown and described it is recognized that other and further modifications may be made while remaining within the scope of the claims below:

What is claimed is:

1. A portable, therapeutic whirlpool chair adapted for use in a water bath for treatment of various perineal and/or perianal illnesses or injuries: said whirlpool chair including:

A) a seat, and at least four supporting legs;

B) said seat having at least one open space in the approximate center thereof, said open space being of a selected size and position to expose a specific bodily area;

C) a hydro pad device positioned below, and a prescribed distance from, said open space in said seat;

D) said hydro pad being mounted on and between said supporting legs, and having means for adjusting the distance between said hydro pad and the under surface of said seat, for altering the force of the whirlpool effect on the area being treated;

E) means for forcing air through said hydro pad to create a whirlpool effect in said water bath.

2. A therapeutic whirlpool chair according to claim 1 wherein said hydro pad comprises:

A) a plenum means defined by an upper surface plate, a lower surface plate spaced a predescribed distance below said upper surface plate, and a surrounding frame means attached around said plates to enclose and form an inner air chamber;

B) said upper surface plate having a plurality of apertures therethrough, in a prescribed pattern, for forcing air out of said plenum and into the water bath;

C) connection means associated with said frame for connecting said hydro pad to said means for forcing air through said hydro pad.

3. A therapeutic whirlpool chair according to claim 1 wherein said means for forcing air through said hydro pad comprises:

A) an electrically powered air compressor of a selected size;

B) a flexible hose connecting said air compressor to said connection means on said frame of said plenum;

C) means for adjusting the pressure of the air forced through said plenum.

4. A therapeutic whirlpool chair according to claim 3 wherein said means for forcing air through said hydro pad further includes a thermostatic means for varying the temperature of the air forced through said hydro pad.

5. A therapeutic whirlpool chair according to claim 3 wherein means for adjusting the pressure through said plenum comprises a rheostat operatively connected to said motor.

6. A therapeutic whirlpool chair according to claim 1 and further including a back portion and a stabilizing means for securing said chair in a chosen position in the water bath; said stabilizing means including:

A) a stabilizer bar mounted horizontally on the rearwardly facing surface of said back portion of said chair; said stabilizer bar including telescoping means on each end thereof for increasing the length of said bar such that said bar will reach a wall or vertical surface on either side of said chair when positioned in the bath;

B) non-skid means mounted on each end of said stabilizer bar to fit securely against the wall or surface adjacent said chair;

C) non-skid means on the end of each of said legs to prevent the chair from sliding out of place in the bath.

* * * * *